US006991132B1

(12) United States Patent
Berryman

(10) Patent No.: US 6,991,132 B1
(45) Date of Patent: Jan. 31, 2006

(54) TUBE SUBSTANCE DISPENSER

(76) Inventor: Paul Berryman, P.O. Box 1851, Brookshire, TX (US) 77423

( * ) Notice: Subject to any disclaimer, the term of this patent is extended or adjusted under 35 U.S.C. 154(b) by 0 days.

(21) Appl. No.: 11/139,414

(22) Filed: May 26, 2005

Related U.S. Application Data

(60) Provisional application No. 60/618,478, filed on Oct. 14, 2004.

(51) Int. Cl.
*B65D 35/28* (2006.01)

(52) U.S. Cl. ..... 222/95; 222/103; 222/105

(58) Field of Classification Search ..... 222/95, 222/101, 103, 105, 106

See application file for complete search history.

(56) References Cited

U.S. PATENT DOCUMENTS

| | | | | |
|---|---|---|---|---|
| 1,711,755 | A * | 5/1929 | Smith | 222/101 |
| 1,772,409 | A * | 8/1930 | Wood | 222/101 |
| 2,795,356 | A * | 6/1957 | Tschumy | 222/103 |
| 4,234,104 | A * | 11/1980 | Apuzzo et al. | 222/101 |
| 4,332,497 | A | 6/1982 | Rodriguez | |
| 4,583,563 | A | 4/1986 | Turner | |
| 4,585,147 | A * | 4/1986 | Wodnicki | 222/103 |
| 5,035,347 | A * | 7/1991 | Trovo | 222/95 |
| 5,711,455 | A * | 1/1998 | Elliott | 222/103 |
| 5,873,490 | A * | 2/1999 | Walpole | 222/95 |
| 5,909,977 | A | 6/1999 | Kuo | |
| 6,401,978 | B1 * | 6/2002 | Young | 222/101 |

* cited by examiner

*Primary Examiner*—Eric Keasel

(57) ABSTRACT

A dispenser which assists an individual in dispensing a substance from a squeezable tube. The dispenser has a bottom-located rotating wheel, that when rotating, causes a volume of material within an incorporated tube to be expelled out of the dispenser.

3 Claims, 4 Drawing Sheets

TUBE SUBSTANCE DISPENSER

I. CROSS-REFERENCE TO RELATED APPLICATIONS

This application claims the benefit of U.S. Provisional Application No. 60/618,478, filed Oct. 14, 2004.

II. BACKGROUND OF THE INVENTION

The present invention concerns that of a dispenser which assists an individual in dispensing a substance from a squeezable tube.

III. DESCRIPTION OF THE PRIOR ART

U.S. Pat. No. 4,583,563, issued to. Turner, discloses a combined toothpaste dispenser and toothbrush comprised of a handle for holding a tube of paste with a rotateable knob of dispensing paste through the bristles.

U.S. Pat. No. 5,909,977, issued to. Kuo and U.S. Pat. No. 4,332,497, issued to. Rodriguez, disclose a combination toothbrush with means to store and dispense toothpaste through the brush.

IV. SUMMARY OF THE INVENTION

The present invention concerns that of a dispenser which assists an individual in dispensing a substance from a squeezable tube. The dispenser has a bottom-located rotating wheel, that when rotating, causes a volume of material within an incorporated tube to be expelled out of the dispenser.

There has thus been outlined, rather broadly, the more important features of a dispenser which dispenses a substance from a squeezable tube that the detailed description thereof that follows may be better understood and in order that the present contribution to the art may be better appreciated. There are, of course, additional features of the dispenser which dispenses a substance from a squeezable tube that will be described hereinafter and which will form the subject matter of the claims appended hereto.

In this respect, before explaining at least one embodiment of the dispenser which dispenses a substance from a squeezable tube in detail, it is to be understood that the dispenser which dispenses a substance from a squeezable tube is not limited in its application to the details of construction and to the arrangements of the components set forth in the following description or illustrated in the drawings. The dispenser which dispenses a substance from a squeezable tube is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present dispenser which dispenses a substance from a squeezable tube. It is important, therefore, that the claims be regarded as including such equivalent constructions insofar as they do not depart from the spirit and scope of the present invention.

It is therefore an object of the present invention to provide a dispenser which dispenses a substance from a squeezable tube which has all of the advantages of the prior art and none of the disadvantages.

It is another object of the present invention to provide a dispenser which dispenses a substance from a squeezable tube which may be easily and efficiently manufactured and marketed.

It is another object of the present invention to provide a dispenser which dispenses a substance from a squeezable tube which is of durable and reliable construction.

It is yet another object of the present invention to provide a dispenser which dispenses a substance from a squeezable tube which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
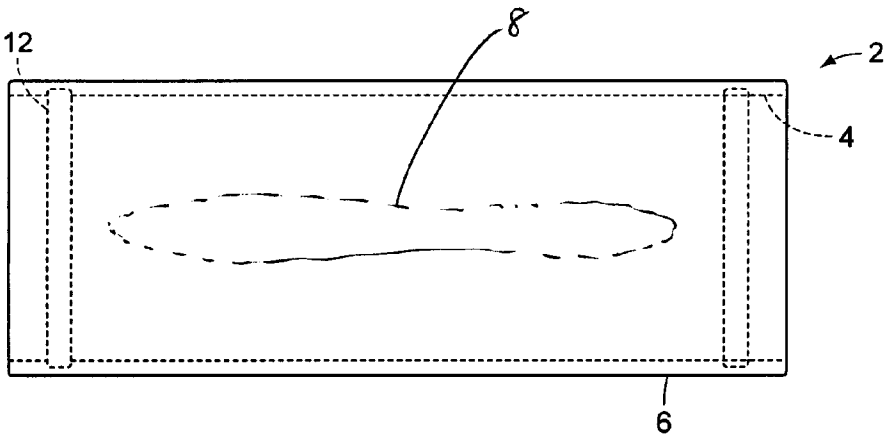
FIG. 1 shows a side view of the outer cylinder.
Figure 2:
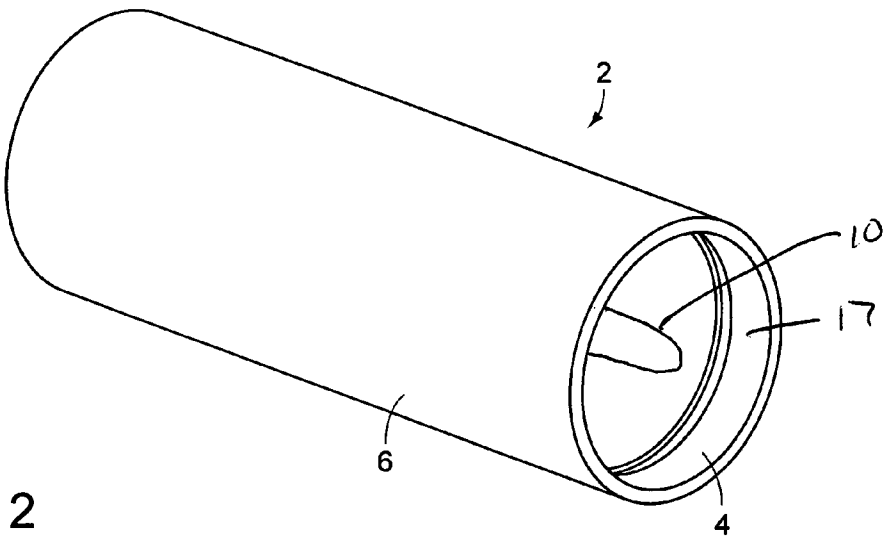
FIG. 2 shows a perspective end view of the outer cylinder.

FIG. 1 shows a side view of the outer cylinder 2, while FIG. 2 shows a perspective end view of the outer cylinder 2. Outer cylinder 2 has two ends, a front end and a rear end, with both ends being open. Outer cylinder 2 also has two surfaces, an inner surface 4 and an outer surface 6.

Outer cylinder 2 has a pair of internal grooves comprising a first internal groove 8 and a second internal groove 10. Each of the grooves has two ends, a first end and a second end, with each of the grooves being embedded onto the inner surface 4 of the outer cylinder 2. The first end of each groove begins near the rear end of the outer cylinder 2, while the second end of each groove is located near the front end of the outer cylinder 2. Each groove is parallel to the other groove and is located one hundred eighty degrees away from the other groove on the inner surface 4 of the outer cylinder 2.

Outer cylinder 2 also has a circumferential cutout 12 that is located near the rear end of the outer cylinder 2. Cutout 12 is also located on the inner surface 4 of the outer cylinder 2 and completely encircles the inner surface 4 of the outer cylinder 2. Cutout 12 has a uniform thickness and depth and is located in between the first end of the grooves 8 and 10 and the rear end of the outer cylinder 2.

Outer cylinder 2 also has a groove 17 that is located on the inner surface 4 of the outer cylinder 2 at the front end of the outer cylinder 2.

Figure 3:
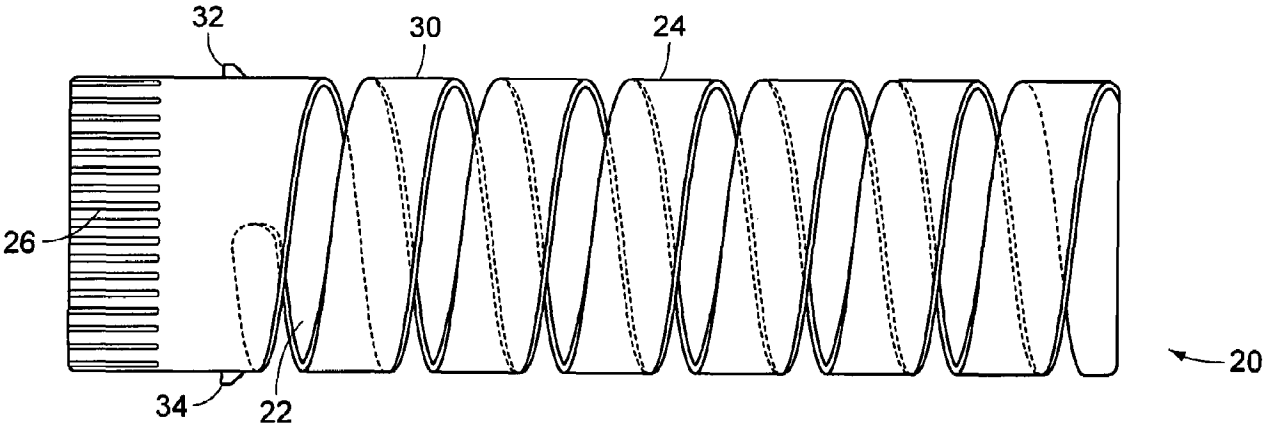
FIG. 3 shows a side view of the inner cylinder.

FIG. 3 shows a side view of the inner cylinder 20. Inner cylinder 20 as two ends, a front end and a rear end, with both ends being open. Inner cylinder 20 also has two surfaces, an inner surface 22 and an outer surface 24.

The rear end of the inner cylinder 20 has a plurality of notches 26 uniformly dispersed on the outer surface 24 of the inner cylinder 20. These notches 26 allow the rear end of the inner cylinder 20 to be more easily grasped so it can be turned once it has been integrated with the outer cylinder 2 and the other components of the present invention. Each of the notches extends from the rear end of the inner cylinder 20 about one-half to one inch inward.

Approximately one and one-half inches to two inches from the rear end of the inner cylinder 20, a cylindrical cutout 30 is present. Cylindrical cutout 30 essentially tapers toward the front end of the inner cylinder as it travels circumferentially around the inner cylinder 20, causing most of the length of inner cylinder 20 to appear like a ribbon which holds a rigid, tubular shape. The diameter of the cylindrical cutout 30 is uniform throughout its length.

Inner cylinder 20 also has a pair of knobs 32 and 34 which are attached to the outer surface 24 of the inner cylinder 20 near the rear end of the inner cylinder 20. Each of the notches is attached to the outer surface 24 the same distance from the rear end of the inner cylinder 20, while the two knobs 32 and 34 are located one-hundred eighty degrees from each other. The knobs 32 and 34 are located at about the location where the cylindrical cutout 30 begins traveling toward the front end of the inner cylinder 20.

Figure 5:
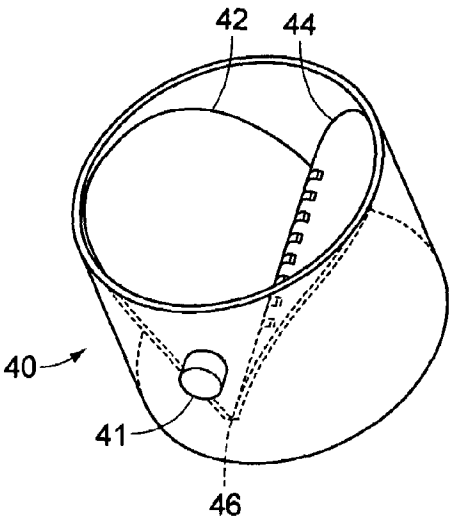
FIG. 5 shows a perspective view of the inner pushing device.
Figure 4:
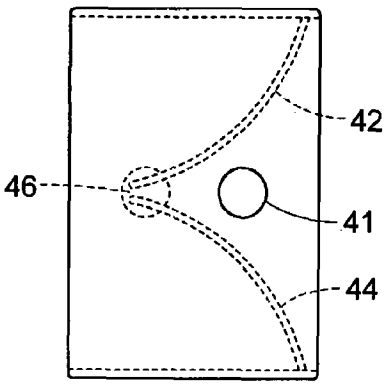
FIG. 4 shows a side view of the inner pushing device.

FIG. 4 shows a side view of the inner pushing device 40, while FIG. 5 shows a perspective view of the inner pushing device 40. Inner pushing device 40 has two ends, a front end and a rear end, and is cylindrical. Inner pushing device 40 has an outer surface.

The inner surface of inner pushing device 40 is not even throughout the length of the inner pushing device 40. Viewed from the front end of the inner pushing device 40, it appears that there are two panels 42 and 44 within the inside of the inner pushing device 40, with the panels 42 and 44 each having two ends, a front end and a rear end.

The front end of each panel is attached to the front end of the inner pushing device 40, with each panel that shaped in a convex manner as it travels down toward the rear end of the inner pushing device 40. Approximately two-thirds of the distance to the rear end of the inner pushing device 40, the two panels 42 and 44 come into very close contact with one another, but they do not actually get to the point where there faces touch. Rather, they cause a slot 46 to be formed, with a slot 46 having two ends, a front end and a rear end. The entire length of slot 46 has the same cross-sectional shape, with the rear end of slot 46 located at the rear end of the inner pushing device 40 and the front end of the slot 46 located approximately one-third the distance from the rear end to the front end of the inner pushing device 40.

The outer surface of the inner pushing device 40 has a knob 41. The knob 41 is circular in shape and has approximately the same diameter as that of the width of the cylindrical cutout 30 on the inner cylinder 20.

Figure 6:
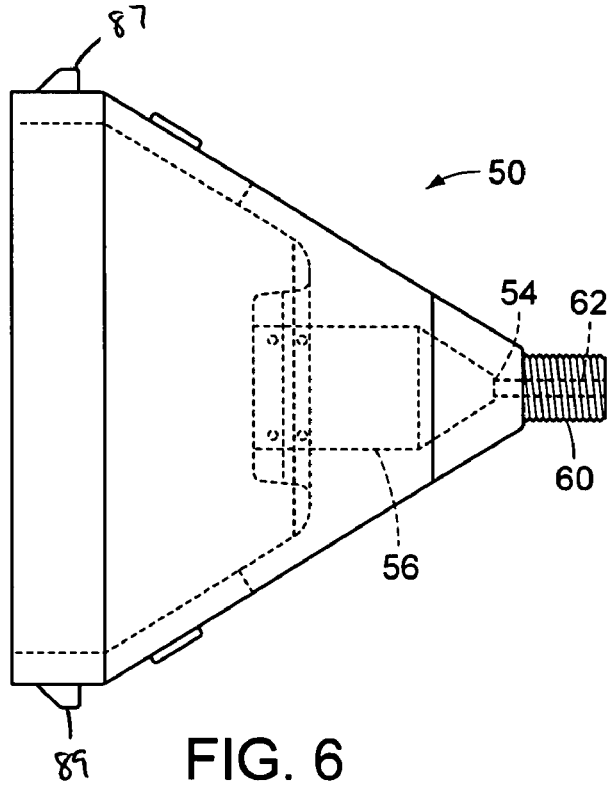
FIG. 6 shows a side view of the nose cone.
Figure 7:
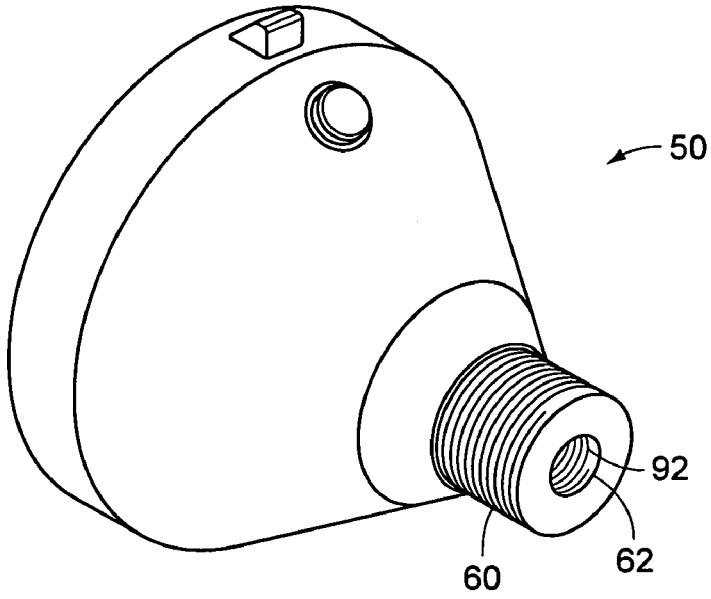
FIG. 7 shows a perspective view of the nose cone.

FIG. 6 shows a side view of the nose cone 50, while FIG. 7 shows a perspective view of the nose cone 50. Nose cone 50 has two ends, a front end and a rear end, and has two surfaces, an inner surface and an outer surface. Nose cone 50 is conically shaped, with the front end of the nose cone 50 being small and the rear end of the nose cone 50 being larger. Nose cone 50 is hollow and has a small hole 54 located on the front end of the nose 50.

Nose cone 50 has a pair of knobs 87 and 89 that are located on the outer surface of the nose cone near the rear end of the nose cone 50. These knobs 87 and 89 are designed to be integrated with the groove 17 on the outer cylinder 2 so that the two pieces can be integrally attached.

Within nose cone 50 is a small nodule 56 that is connected to the hole 54. Nodule 56 is essentially a rigid small tube that has two ends, a first end and a second end, with the first end being connected to the hole 54.

Nose cone 50 also has a small tip 60 that is attached to the front end of the nose cone 50. Tip 60 has a central hole 62.

To use the present invention, the rear end of the inner pushing device 40 is placed against the front end of the inner cylinder 20 in a manner that allows the knob 41 on the outer surface of the inner pushing device 40 to be inserted into the cylindrical cutout 30 at the front end of the inner cylinder 20. Then, the inner pushing device 40 can be rotated until it reaches all the way down until the end of the cylindrical cutout 30.

Next, the rear end of the inner cylinder 20 would be inserted into the front end of the outer cylinder 2 until the knobs 32 and 34 would be within the circumferential cutout 12 on the outer cylinder 2. In this position, the notches 26 on the rear end of the inner cylinder 20 stick outside the rear end of the outer cylinder 2, making them accessible for easy rotation of the inner cylinder 20 within the outer cylinder 2.

Figure 8:
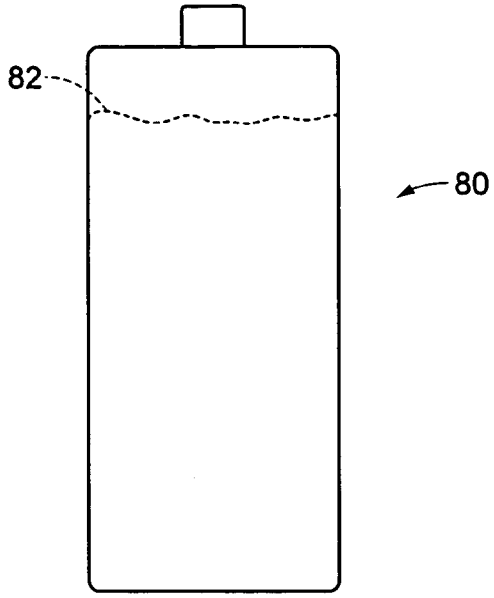
FIG. 8 shows a side view of a tube used with the present invention.

Next, an individual would take an open end of a tube 80, as seen in FIG. 8, and fixedly attach it to the second end of the nodule 56. The tube 80 has two ends, an open end and a closed end, with the open end being the end in which material in the tube is expelled after a cap has been removed. The tube 80 is then inserted into the front end of the inner cylinder 20/outer cylinder 2 combination until the closed end of the tube is located within the slot 46 on the inner pushing device 40 (the location of the inner pushing device 40 may have to be changed to accommodate this necessary physical connection). Once this occurs, the knobs 87 and 89 located on the outer surface of the nose cone 50 near the rear end of the nose cone 50 are selectively coupled to the groove 17 on the outer cylinder 2 so that the two pieces can be integrally attached.

Each time an individual wants to expel a small amount of material 82 within the tube 80 out of the open end of the tube and onward through the hole 54 and tip 60, an individual merely needs to the turn the inner cylinder 20 in relation to the outer cylinder 2 a small distance, which forces the inner pushing device 40 upward toward the front end of the inner cylinder 20. This action, in turn, causes the tube 80 to be compressed, squeezing out some of the material 82 within the tube 80 out of the hole 54 and tip 60.

Figure 9:
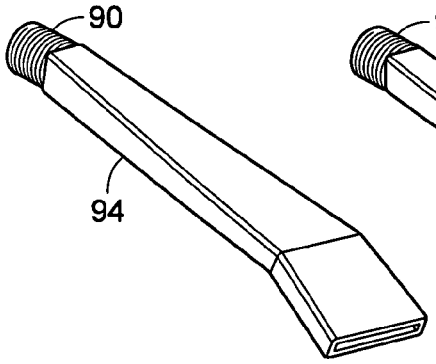
FIGS. 9 through 11 show various nozzle attachments that could be used with the present invention.
Figure 10:
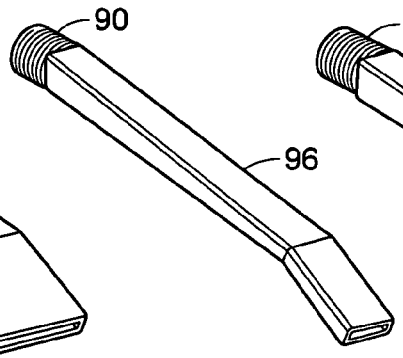
Figure 11:
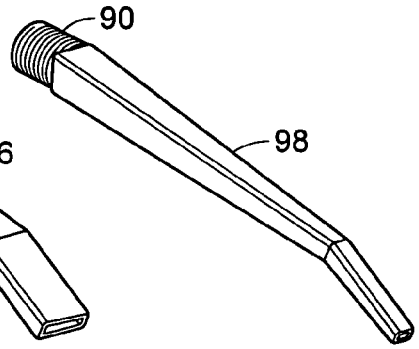

FIGS. 9 through 11 show various nozzle attachments that could be used with the present invention. Each nozzle attachment has two ends, an attached end and a free end, with the attached end having external threads 90 and being designed to threadably attach to internal threads 92 located within the hole 62 on the tip 60. FIG. 9 shows attachment 94, with attachment 94 having a one-half inch wide hole on its free end. FIG. 10 shows attachment 96, with attachment 96 having a one-fourth inch wide hole on its free end. FIG. 11 shows attachment 98, with attachment 98 having a fine hole on its free end.

Figure 12:
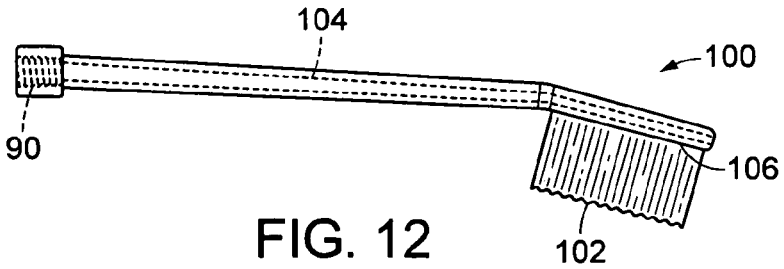
FIG. 12 shows a brush attachment that could be used with the present invention.

FIG. 12 shows a brush attachment 100 that could be used with the present invention. Brush attachment 100 has two ends, a free end and an attached end, with the attached end having external threads 90 and being designed to threadably attach to internal threads 92 located within the hole 62 on the tip 60.

Brush attachment 100 has a plurality of bristles 102 on its free end and has an internal tube 104 within brush attachment 100. The internal tube 104 has two ends, an attached end and a bristle end. The bristle end is attached to a plurality of holes 106 located near the plurality of bristles

102. The attached end of the internal tube 104 is located at the attached end of the brush attachment. When utilizing the brush attachment 100, any material squeezed out of tip 62 will be squeezed through internal tube 104 and out onto the plurality of bristles 102, where it can be used in conjunction with the plurality of bristles 102 for scrubbing or cleaning purposes, as the case may be.

What I claim as my invention is:

1. A dispenser which assists an individual in dispensing a substance from a squeezable tube, the dispenser comprising:

(a) an outer cylinder having two ends, a front end and a rear end, the outer cylinder also having two surfaces, an inner surface and an outer surface, each of the ends of the outer cylinder being open, (b) a pair of internal grooves located within the outer cylinder comprising a first internal groove and a second internal groove, each of the grooves having two ends, a first end and a second end, each of the grooves being embedded on the inner surface of the outer cylinder, the first end of each groove being located near the rear end of the outer cylinder, the second end of each groove being located near the front end of the outer cylinder, each of the grooves being located parallel to one another, each of the grooves being located one hundred eighty degrees away from the other groove, (c) a circumferential cutout located near the rear end of the outer cylinder, the cutout being located on the inner surface of the outer cylinder, the cutout completely encircling the inner surface of the outer cylinder, the cutout being located in between the first end of the each of the grooves and the rear end of the outer cylinder, (d) a groove located on the inner surface of the outer cylinder at the front end of the outer cylinder, (e) an inner cylinder having two ends, a front end and a rear end, each of the ends being open, the inner cylinder also having two surfaces, an inner surface and an outer surface, (f) a plurality of notches attached to the rear end of the inner cylinder, the plurality of notches being uniformly dispersed on the outer surface of the inner cylinder, (g) a cylindrical cutout attached to the inner cylinder, (h) a pair of knobs attached to the outer surface of the inner cylinder near the rear end of the inner cylinder, each of the two knobs being located one hundred eighty degrees from each other, (i) an inner pushing device having two ends, a front end and a rear end, the inner pushing device being cylindrical, the inner pushing device having an outer surface, the inner pushing device having two internal panels, each of the panels having two ends, a front end and a rear end, (j) a slot located in the inner pushing device, the slot having two ends, a front end and a rear end, (k) a knob located on the outer surface of the inner pushing device, the knob being circular in shape, (l) a nose cone having two ends, a front end and a rear end, the nose cone also having two surfaces, an inner surface and an outer surface, the nose cone being conically shaped, the nose cone having a small hole located on the front end of the nose, (m) a pair of knobs attached to the outer surface of the nose cone near the rear end of the nose cone, (n) a small nodule located within the nose cone, the small nodule being attached to the small hole located on the front end of the nose, (o) a tip attached to the front end of the nose cone, the tip having a central hole, (p) a tube, the tube having two ends, an open end and a closed end, (q) a nozzle attachment having two ends, an attached end and a free end, the attached end being attachable to the hole located on the tip, (r) wherein the rear end of the inner pushing device is placed against the front end of the inner cylinder in a manner that allows the knob on the outer surface of the inner pushing device to be inserted into the cylindrical cutout at the front end of the inner cylinder, (s) further wherein the inner pushing device can be rotated until it reaches all the way down until the end of the cylindrical cutout, (t) further wherein the rear end of the inner cylinder is inserted into the front end of the outer cylinder until the pair of knobs attached to the inner cylinder are within the circumferential cutout on the outer cylinder, causing the notches on the rear end of the inner cylinder to stick outside the rear end of the outer cylinder, making them accessible for easy rotation of the inner cylinder within the outer cylinder, (u) further wherein takes the open end of the tube and fixedly attaches it to the second end of the nodule, further wherein the tube is then inserted into the front end of the inner cylinder and outer cylinder combination until the closed end of the tube is located within the slot on the inner pushing device, further wherein the pair of knobs located on the outer surface of the nose cone near the rear end of the nose cone are selectively coupled to the groove on the outer cylinder so that the two pieces can be integrally attached, (v) further wherein an individual merely needs to the turn the inner cylinder in relation to the outer cylinder a small distance, which forces the inner pushing device upward toward the front end of the inner cylinder, further wherein this causes the tube to be compressed, squeezing out some of the material within the tube out of the hole and tip.

2. A dispenser which assists an individual in dispensing a substance from a squeezable tube according to claim 1 wherein each of the notches of the pair of notches attached to the inner cylinder extends from the rear end of the inner cylinder about one-half to one inch inward.

3. A dispenser which assists an individual in dispensing a substance from a squeezable tube according to claim 2 wherein the knob attached to the outer surface of the inner pushing device has the same diameter as that of the width of the cylindrical cutout on the inner cylinder.

* * * * *